US007086485B2

(12) United States Patent
Moriarty et al.

(10) Patent No.: US 7,086,485 B2
(45) Date of Patent: Aug. 8, 2006

(54) DIRECTIONAL CASING DRILLING

(75) Inventors: Keith Alan Moriarty, Houston, TX (US); Michael Robert Johnson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/735,312

(22) Filed: Dec. 12, 2003

(65) Prior Publication Data

US 2005/0126825 A1 Jun. 16, 2005

(51) Int. Cl.
*E21B 10/66* (2006.01)

(52) U.S. Cl. ..... 175/61; 175/62; 175/258

(58) Field of Classification Search ..... 175/61, 175/62, 75, 76, 258, 262
See application file for complete search history.

(56) References Cited

U.S. PATENT DOCUMENTS 2,771,275 A * 11/1956 Ortloff ..... 175/259
4,616,719 A * 10/1986 Dismukes ..... 175/94
4,842,081 A 6/1989 Parant
5,082,069 A 1/1992 Seiler et al.
5,117,927 A 6/1992 Askew
5,148,875 A * 9/1992 Karlsson et al. ..... 175/62
5,168,942 A * 12/1992 Wydrinski ..... 175/50
5,197,553 A 3/1993 Leturno
5,219,028 A 6/1993 Martin et al.
5,255,741 A 10/1993 Alexander
5,452,967 A 9/1995 Fuller
5,456,326 A 10/1995 Raines
5,472,057 A * 12/1995 Winfree ..... 175/57
5,662,170 A 9/1997 Donovan et al.
5,755,289 A 5/1998 Angman et al.
5,839,519 A 11/1998 Spedale, Jr.
5,845,722 A 12/1998 Makohl et al.
5,921,332 A 7/1999 Spedale, Jr.

(Continued)

FOREIGN PATENT DOCUMENTS

EP 0462618 A2 12/1991
WO WO00/37771 6/2000

(Continued)

*Primary Examiner*—William Neuder
(74) *Attorney, Agent, or Firm*—Jennie Salazar; Brigitte L. Echols; Dale V. Gaudier

(57) ABSTRACT

A directional drilling system, including a casing string, a casing latch disposed inside the casing string proximate a lower end of the casing string and coupled to the casing string, a rotary steerable system disposed inside the casing string and coupled to the casing latch, and a drill bit coupled to the rotary steerable system.

13 Claims, 6 Drawing Sheets

U.S. PATENT DOCUMENTS

| | | | | |
|---|---|---|---|---|
| 5,950,742 | A | 9/1999 | Caraway | |
| 5,957,225 | A | 9/1999 | Sinor | |
| 6,102,119 | A | 8/2000 | Raines | |
| 6,158,531 | A | 12/2000 | Vail, III | |
| 6,182,776 | B1 | 2/2001 | Asberg | |
| 6,196,336 | B1 | 3/2001 | Fincher et al. | |
| 6,199,641 | B1 | 3/2001 | Downie et al. | |
| 6,227,306 | B1 | 5/2001 | Downie et al. | |
| 6,263,987 | B1 | 7/2001 | Vail, III | |
| 6,311,792 | B1 | 11/2001 | Scott et al. | |
| 6,705,413 | B1 * | 3/2004 | Tessari | 175/22 |
| 6,877,570 | B1 * | 4/2005 | Chen et al. | 175/22 |
| 2002/0040787 | A1 | 4/2002 | Cook et al. | |
| 2002/0050360 | A1 | 5/2002 | Cook et al. | |
| 2002/0175003 | A1 | 11/2002 | Pisoni et al. | |
| 2002/0179336 | A1 | 12/2002 | Schaaf et al. | |
| 2004/0144566 | A1 * | 7/2004 | Fisher | 175/55 |
| 2004/0245020 | A1 * | 12/2004 | Giroux et al. | 175/61 |

FOREIGN PATENT DOCUMENTS

| | | | |
|---|---|---|---|
| WO | WO00/50730 | | 8/2000 |
| WO | WO01/83932 | A1 | 11/2001 |
| WO | WO01/86111 | A1 | 11/2001 |
| WO | WO01/94738 | A1 | 12/2001 |
| WO | WO01/94739 | A1 | 12/2001 |
| WO | WO02/10549 | A2 | 2/2002 |
| WO | WO02/14649 | A1 | 2/2002 |

* cited by examiner

DIRECTIONAL CASING DRILLING

BACKGROUND OF THE INVENTION

Wells are generally drilled into the ground to recover natural deposits of hydrocarbons and other desirable materials trapped in geological formations in the Earth's crust. A well is typically drilled using a drill bit attached to the lower end of a "drill string." The drill string is a long string of sections of drill pipe that are connected together end-to-end. Drilling fluid, or mud, is typically pumped down through the drill string to the drill bit. The drilling fluid lubricates and cools the drill bit, and it carries drill cuttings back to the surface in the annulus between the drill string and the borehole wall.

In conventional drilling, a well is drilled to a selected depth, and then the wellbore is typically lined with a larger-diameter pipe, usually called casing. Casing typically consists of casing sections connected end-to-end, similar to the way drill pipe is connected. To accomplish this, the drill string and the drill bit are removed from the borehole in a process called "tripping." Once the drill string and bit are removed, the casing is lowered into the well and cemented in place. The casing protects the well from collapse and isolates the subterranean formations from each other.

Conventional drilling typically includes a series of drilling, tripping, casing and cementing, and then drilling again to deepen the borehole. This process is very time consuming and costly. Additionally, other problems are often encountered when tripping the drill string. For example, the drill string may get caught up in the borehole while it is being removed. These problems require additional time and expense to correct.

FIG. 1A shows a prior art drilling operation. A drilling rig 101 and rotary table 104 at the surface are used to rotate a drill string 103 with a drill bit 105 disposed at the lower end of the drill string 103. The drill bit 105 drills a borehole 107 through subterranean formations that may contain oil and gas deposits. Typically, an MWD (measurement while drilling) or LWD (logging while drilling) collar 109 is positioned just above the drill bit 105 to take measurements relating to the properties of the formation as the borehole 107 is being drilled. In this description, MWD is used to refer either an MWD system or an LWD system. Those having ordinary skill in the art will realize that there are differences between these two types of systems, but the differences are not germane to the embodiments of the invention.

The term "casing drilling" refers to using a casing string as a drill string when drilling. A bottom hole assembly ("BHA"), including a drill bit, is connected to the lower end of a casing string, and the well is drilled using the casing string to transmit drilling fluid, as well as axial and rotational forces, to the drill bit. Casing drilling enables the well to be simultaneously drilled and cased.

FIG. 1B shows a prior art casing drilling operation. A rotary table 124 at the surface is used to rotate a casing string 123 that is being used as a drill string. The casing 123 extends downwardly into borehole 127. A drill bit 125 is connected to the lower end of the casing string 123. When drilling with casing, the drill bit 125 must be able to pass though the casing string 123 so that the drill bit 125 may be retrieved when drilling has been completed or when replacement or maintenance of the drill bit 125 is required. Thus, the drill bit 125 is sized smaller than the inner diameter of the casing string 123.

The drill bit 125 drills a pilot hole 128 that must be enlarged so that the casing string 123 will be able to pass through the borehole 127. An underreamer 124 is positioned below the casing string 123 and above the drill bit 125 so as to enlarge the pilot hole 128. A typical underreamer 124 can be positioned in an extended and a retracted position. In the extended position, the underreamer 124 enlarges the pilot hole 128 to the underreamed borehole 127, and in the retracted position (not shown), the underreamer 124 collapses so that it is able to pass through the inside of the casing string 123.

FIG. 1B also shows an MWD collar 135 positioned above the drill bit 125 and the underreamer 124, but below the casing string 123. The MWD collar 135 takes measurements related to formation properties as drilling is taking place.

Casing drilling eliminates the need to trip the drill string before the well is cased. The drill bit may simply be retrieved by pulling it up through the casing. The casing may then be cemented in place, and then drilling may continue. This reduces the time required to retrieve the BHA and eliminates the need to subsequently run casing into the well.

Another aspect of drilling is called "directional drilling." Directional drilling is the intentional deviation of the wellbore from the path it would naturally take. In other words, directional drilling is the steering of the drill string so that it travels in a desired direction.

Directional drilling is advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of an planned drilling trajectory because of the unpredictable nature of the formations being penetrated or the varying forces that the drill bit experiences. When such a deviation occurs, a directional drilling system may be used to put the drill bit back on course.

One method of directional drilling uses a bottom hole assembly ("BHA") that includes a bent housing and a mud motor. A bent housing 200 is shown in FIG. 2A. The bent housing 200 includes an upper section 203 and a lower section 204 that are formed on the same section of drill pipe, but are separated by a bend 201. The bend 201 is a permanent bend in the pipe.

With a bent housing 200, the drill string is not rotated from the surface.

Instead, the drill bit 205 is pointed in the desired drilling direction, and the drill bit 205 is rotated by a mud motor (not shown) located in the BHA. A mud motor converts some of the energy of the mud flowing down through the drill pipe into a rotational motion that drives the drill bit 205. Thus, by maintaining the bent housing 200 at the same azimuthal position with respect to the borehole, the drill bit 205 will drill in the desired direction.

When straight drilling is desired, the entire drill string, including the bent housing 200, is rotated from the surface. The drill bit 205 angulates with the bent housing 200 and drills a slightly overbore, but straight, borehole (not shown).

Another method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling.

Generally, there are two types of RSS's—"point-the-bit" systems and "push-the-bit" systems. In a point-the-bit system, the drill bit is pointed in the desired direction of the borehole deviation, similar to a bent housing. In a push-the-bit system, devices on the BHA push the drill bit laterally in the direction of the desired borehole deviation by pressing on the borehole wall.

A point-the-bit system works in a similar manner to a bent housing because a point-the-bit system typically includes a mechanism for providing a drill bit alignment that is different from the drill string axis. The primary differences are that a bent housing has a permanent bend at a fixed angle, and a point-the-bit RSS has an adjustable bend angle that is controlled independent of the rotation from the surface.

FIG. 2B shows a point-the-bit RSS 210. A point-the-bit RSS 210 typically has an drill collar 213 and a drill bit shaft 214. The drill collar 213 includes an internal orientating and control mechanism (not shown) that counter-rotates relative to the drill string. This internal mechanism controls the angular orientation of the drill bit shaft 214 relative to the borehole (not shown).

The angle θ between the drill bit shaft 214 and the drill collar 213 may be selectively controlled. The angle θ shown in FIG. 2B is exaggerated for purposes of illustration. A typical angle is less than 2 degrees.

The "counter rotating" mechanism rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geo-stationary" by those skilled in the art. In this disclosure, no distinction is made between the terms "counter rotating" and "geo-stationary."

A push-the-bit system typically uses either an internal or an external counter-rotation stabilizer. The counter-rotation stabilizer remains at a fixed angle (or geo-stationary) with respect to the borehole wall. When the borehole is to be deviated, an actuator presses a pad against the borehole wall in the opposite direction from the desired deviation. The result is that the drill bit is pushed in the desired direction.

FIG. 2C shows a typical push-the-bit system 220. The drill string 223 includes a counter-rotating collar 221 that includes one or more extendable and retractable pads 226. Because the pads 226 are disposed on the counter-rotating collar 221, they do not rotate with respect to the borehole (not shown). When a pad 226 is extended into contact with the borehole (not shown) during drilling, the drill bit 225 is pushed in the opposite direction, enabling the drilling of a deviated borehole.

FIG. 3 shows a prior art drilling system that includes both casing drilling and directional drilling. A rotary table 304 is used to rotate a casing string 311 that is being used as a drill string. A drill bit 305 and an underreamer 313 are positioned at the lower end of the casing string 311. The drill bit 305 drills a pilot hole 308 that is enlarged to an underreamed borehole 307 by the underreamer 313.

The casing drilling system also includes an RSS 315 that is positioned blow the casing string 311 and between the drill bit 305 and the underreamer 313. The RSS 315 is used to change the direction of the drill bit 305.

Nonetheless, a need still exists for an improved drilling system.

SUMMARY OF INVENTION

In one or more embodiment, the invention relates to a directional drilling system that includes a casing string and a casing latch disposed inside the casing string near a lower end of the casing string and coupled to the casing string. The system may also include a rotary steerable system disposed inside the casing string and coupled to the casing latch and a drill bit coupled to the rotary steerable system. In some embodiments the rotary steerable system comprises a "push-the-bit" system.

In one or more embodiments, the invention relates to a method of directional drilling that includes rotating a drill bit disposed at a lower end of a casing string and changing the direction of the drill bit by pushing against an inside of the casing string with a rotary steerable system disposed inside the casing string.

Other aspects and advantages of the invention will be apparent from the following description and the appended claims.

DETAILED DESCRIPTION

In some embodiments, the invention relates to a directional casing drilling system with a rotary steerable system disposed inside the casing. In some other embodiments, the invention related to a method of directional drilling with casing.

Figure 1A:
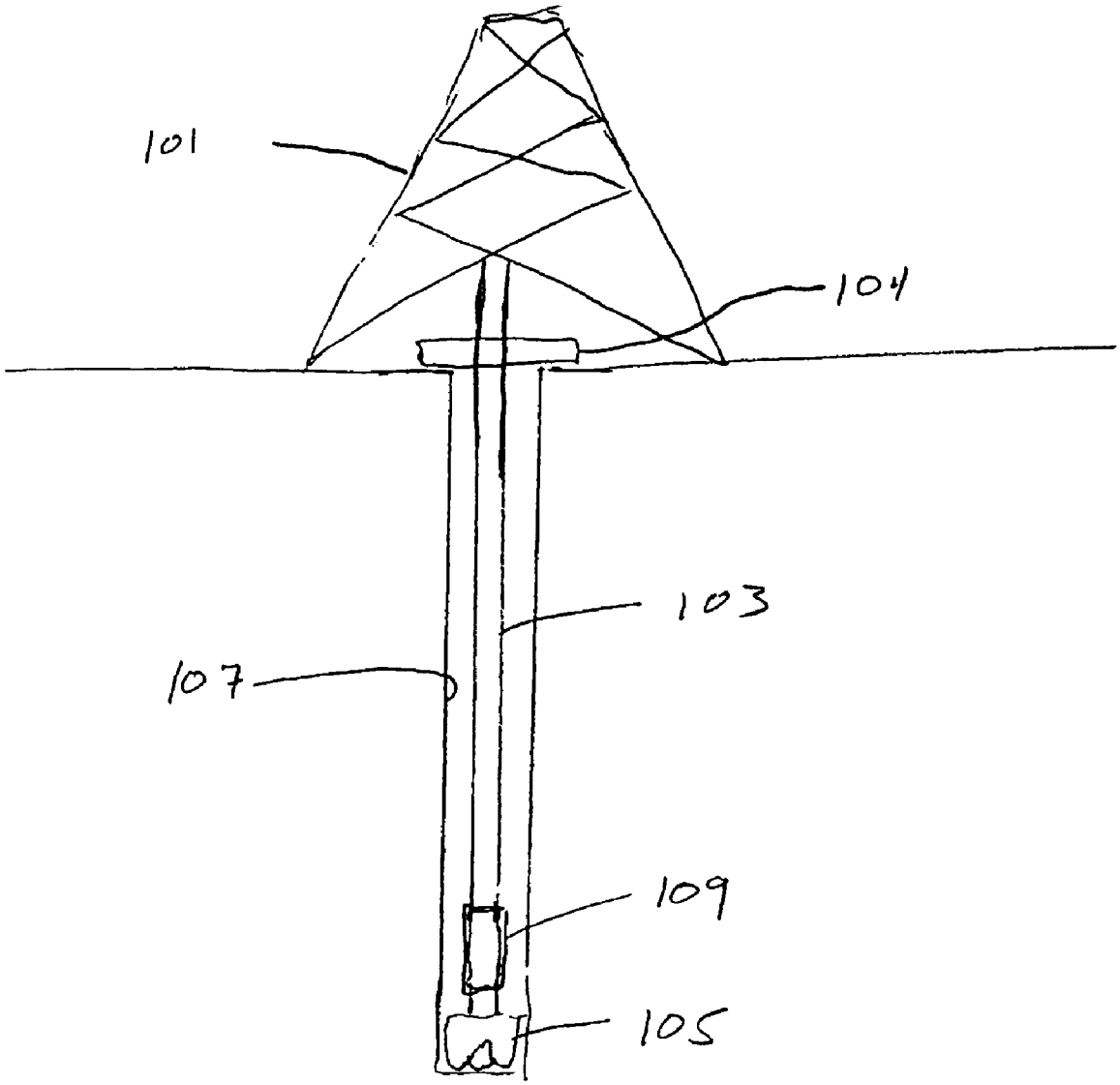
FIGURE 1A (PRIOR ART)
FIG. 1A shows a prior art drilling operation.
Figure 1B:
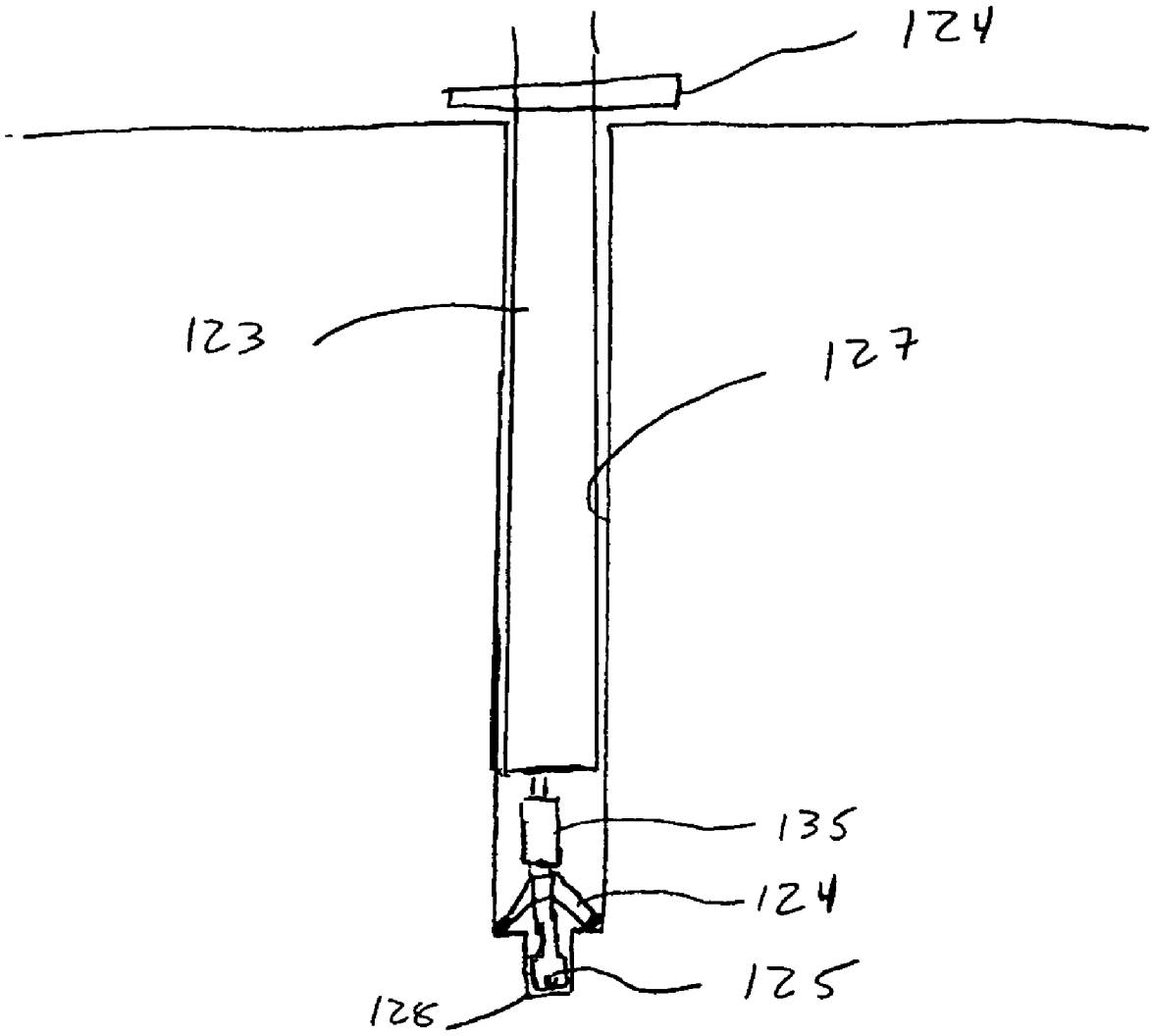
FIGURE 1B (PRIOR ART)
FIG. 1B shows a prior art casing drilling operation.
Figure 2A:
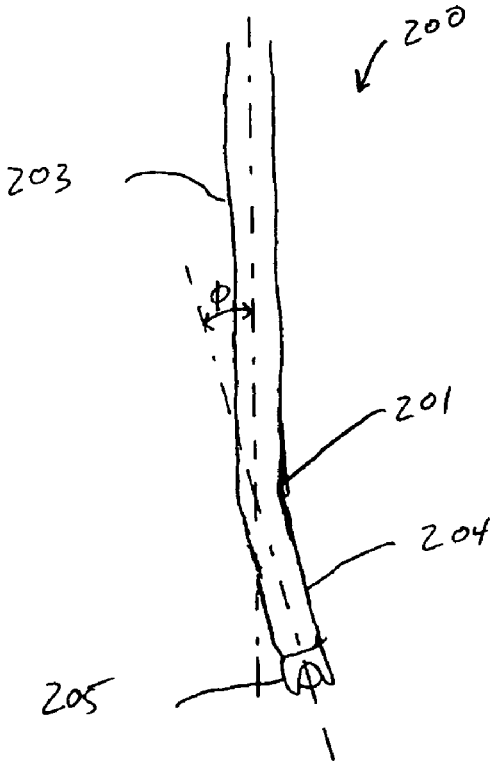
FIGURE 2A (PRIOR ART)
FIG. 2A shows a prior art bent housing.
Figure 2B:
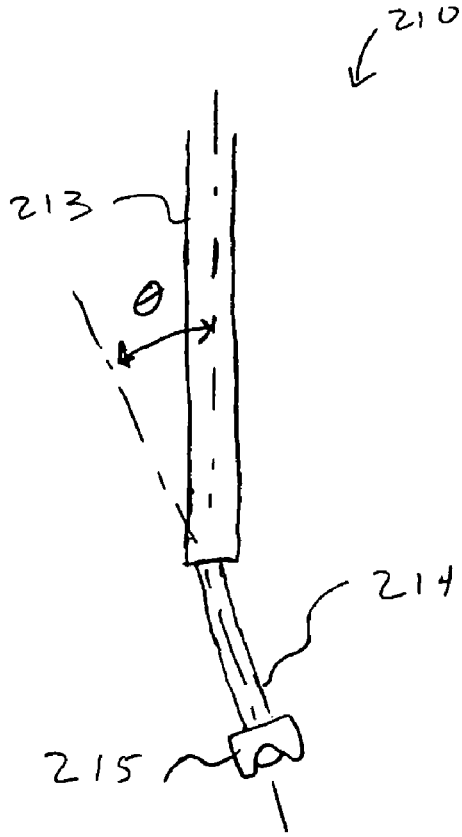
FIGURE 2B (PRIOR ART)
FIG. 2B shows a prior art "point-the-bit" system.
Figure 2C:
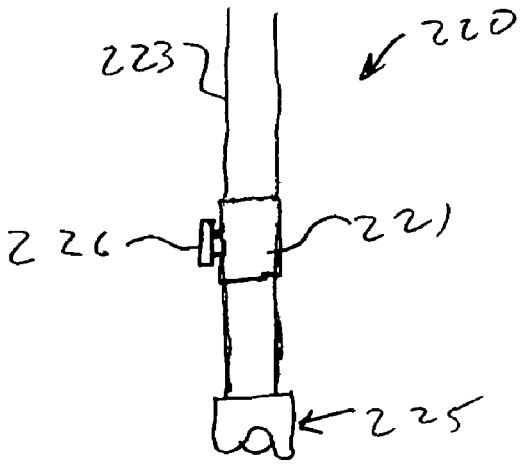
FIGURE 2C (PRIOR ART)
FIG. 2C shows a prior art "push-the-bit" system.
Figure 3:
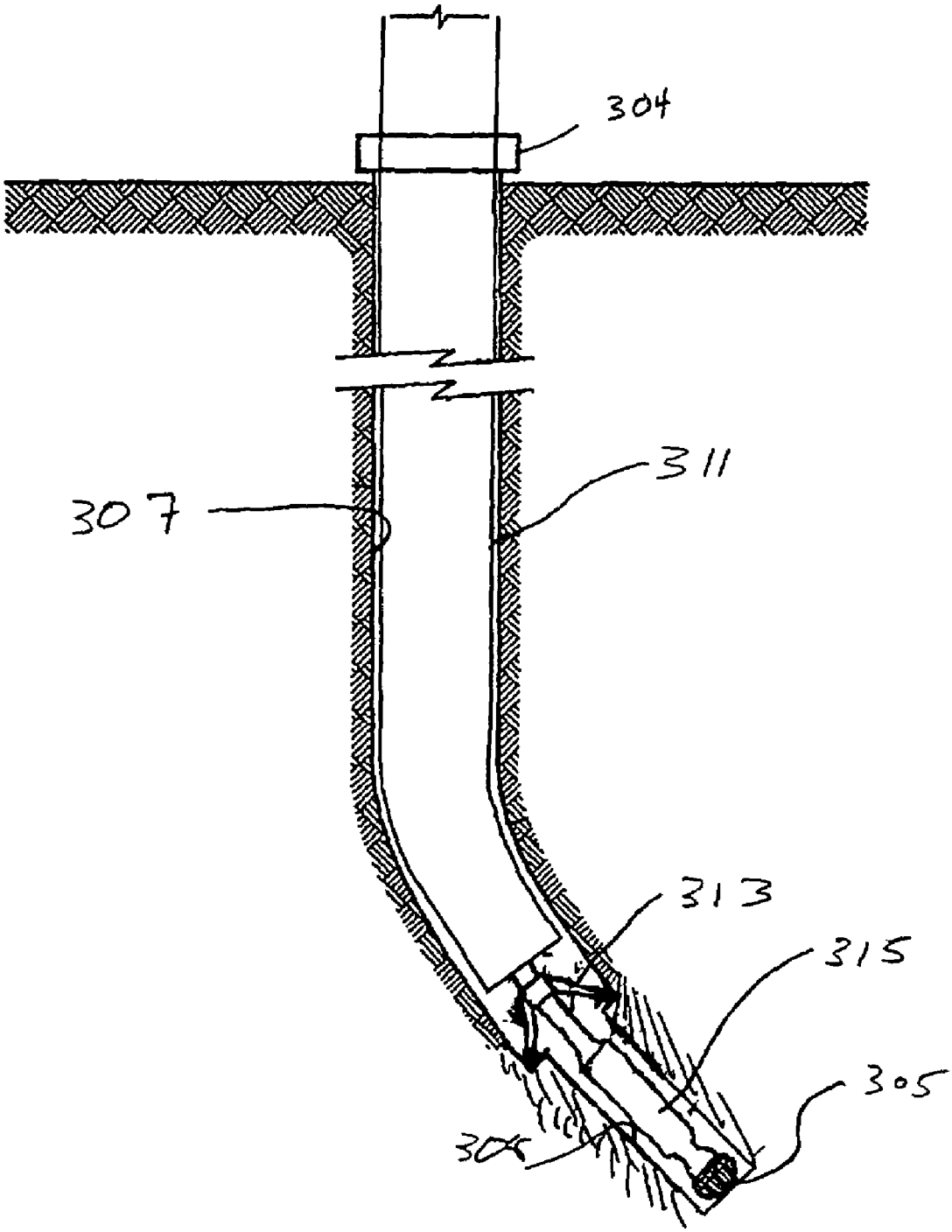
FIGURE 3 (PRIOR ART)
FIG. 3 shows a prior art directional casing drilling operation.
Figure 4:
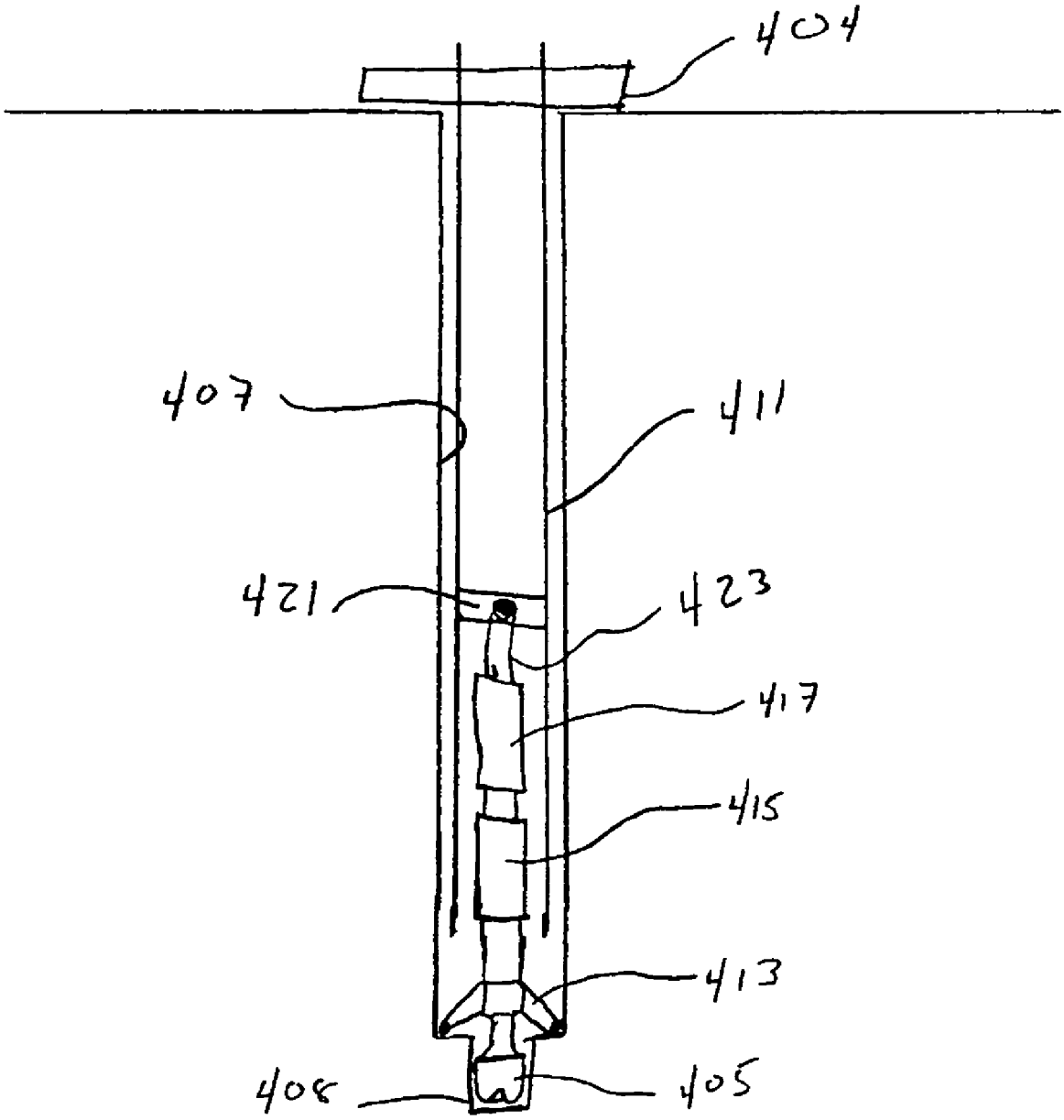
FIG. 4 shows a directional casing drilling system in accordance with one embodiment of the invention.

FIG. 4 shows a directional casing drilling system in accordance with one embodiment of the invention. A rotary table 404 at the surface is used to rotate a casing string 411 that is being used as a drill string. The casing string 411 transmits the rotary motion to a drill bit 405 and an underreamer 413 that are positioned below the lower end of the casing string 411. The drill bit 405 drills a pilot hole 408 that is enlarged by the underreamer 413 to a size that will enable the casing string 411 to bass through the borehole 407.

The directional casing system shown in FIG. 4 also includes an RSS 415 that is positioned above the underreamer 413 and inside the casing string 411. The RSS 415 may be either a push-the-bit or a point-the-bit system, as will be described. In some embodiments, such as the one shown in FIG. 4, an MWD collar 417 is positioned above the RSS 415 and within the casing string 411.

A pipe section 423 connects the MWD collar 417, RSS 415, underreamer 413, and drill bit 405 to the casing string 411. The pipe section 423 is coupled to the casing string 411 by a casing latch 421, which will be described below. The section of pipe 423 may be a section of normal drill pipe that fits within the casing string 411.

The casing latch 421 couples the pipe section 423 to the casing string 411 in a manner that will transfer the rotary motion of the casing string 411 to the drill bit 415 and underreamer 413. In some embodiments, the casing latch 421 also allows articulation of the pipe section 423—along with the MWD collar, the RSS, the underreamer 413, and the drill bit 415—so that that drill bit may be pointed in a desired direction. In some embodiments, the casing latch 421 also seals against the inside of the casing string 411 so that the drilling fluid is forced to flow through the pipe section 423 and to the drill bit 405.

The RSS 415 is located inside the casing string 411. In some embodiments, the RSS 415 may comprise a point-the-bit system, but in a preferred embodiment, the RSS 415 comprises a push-the-bit system that pushes against the inside of the casing string 411. In at least one embodiment, a push-the-bit RSS 415 includes an internal counter-rotating mechanism that remains in the same azimuthal position with respect to the borehole. In the art, this is referred to as "geo-stationary."

In embodiments where a push-the-bit RSS 415 includes an internal counter-rotating mechanism (not shown), the counter-rotating mechanism activates one or more pads (not shown) on the periphery of the RSS. The pads are activated in succession so that each pad is pressed against the inside of the casing string 411 in the same angular or azimuthal direction, and the drill bit 405 is pushed in the desired direction.

In other embodiments, a push-the-bit RSS 415 includes an external counter-rotating, or geo-stationary, section (not shown). Because the counter-rotating section is at the periphery of the RSS, only one pad (not shown) needs to be extended to contact the inside of the casing string 411.

The type of RSS that is used with the invention is not intended to limit the invention. Those having ordinary skill in the art will be able to devise other types of rotary steerable systems that may be used without departing from the scope of the invention.

In some embodiments, the last section of the casing string 411, which also includes the casing latch 421, is constructed of a nonmagnetic material. A nonmagnetic material will enable more accurate measurements to be made by the MWD collar 417 than would be possible with other magnetic materials. It is noted that none of the Figures show the individual sections of the casing string, but those having ordinary skill in the art will realize that a casing string is typically comprised of many sections of casing that are connected together.

Figure 5:
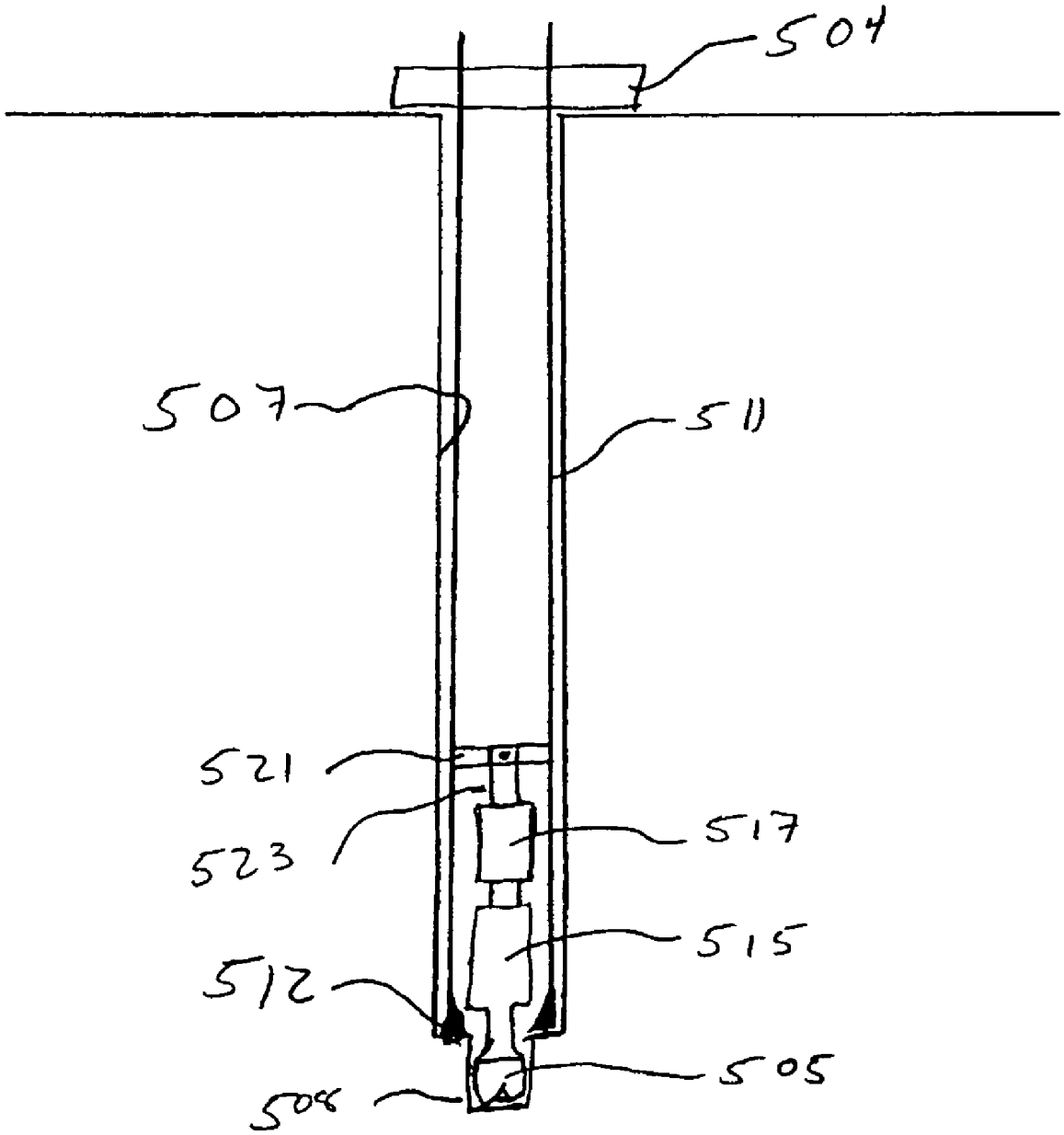
FIG. 5 shows a directional casing drilling system in accordance with another embodiment of the invention.

FIG. 5 shows a directional casing drilling system in accordance with another embodiment of the invention. A rotary table 504 is used to rotate a casing string 511 that is used as a drill string. The casing string transmits the rotary motion to a drill bit 505 positioned below the casing string 511. The embodiment shown in FIG. 5 does not include a underreamer (e.g., underreamer 413 in FIG. 4) to enlarge the pilot hole 508 to a size that will allow the casing string 511 to pass through the borehole 507. Instead, the lower edge of the casing string 511 comprises a casing shoe cutter 512.

The casing shoe cutter 512 is a mechanism that will enlarge the pilot hole 508 as the casing is moved downwardly through the subterranean formations. This will eliminate the need for an underreamer and still enable the drill bit 505 to pass through the casing string when it is retrieved. In some embodiments, the casing shoe cutter 512 is thicker than the remainder of the casing string 511 so that the casing shoe cutter 512 has the same outer diameter as the casing string 511 and a smaller inner diameter.

The casing shoe cutter 512 may be constructed of any suitable material. For example, the casing shoe cutter 512 may be constructed of steel and a wear resistant coating, such as polycrystalline diamonds or a tungsten carbide. In some embodiments, the casing shoe cutter 512 may include teeth or inserts that enable more efficient cutting. Those having skill in the art will be able to devise other types of casing shoe cutters without departing from the scope of the invention.

The directional casing drilling system shown in FIG. 5 also includes an RSS 515 that is disposed above the drill bit 505 and inside the casing string 511. The RSS 515 and an MWD collar 517 are coupled to the casing string by a pipe section 523 and an articulating casing latch 521. The RSS 515, the MWD collar 517, and the casing latch 521 are not significantly different from those described with reference to FIG. 4, and, for the sake of brevity, that description will not be repeated here.

Certain embodiments of the present invention may present one or more of the following advantages. An RSS located inside the casing string will be protected from the otherwise harsh environment of the borehole. For example, while drilling fluid will pass through the RSS as it flows toward the drill bit, the outer surface of the RSS may not be subjected to the return flow of mud that includes drill cutting that are being carried back to the surface.

Advantageously, by locating a push-the-bit RSS inside a casing string, the RSS may include an external counter-rotating mechanism that will not become caught or stuck on the borehole wall. Further, only one pad need be extended to contact the inside of the casing string. By using only one pad, the pressure and force applied to the drill bit can be more easily controlled and regulated.

Advantageously, a pad in a push-the-bit RSS in accordance with one or more embodiments of the invention will not contact the borehole wall, where it can cause damage to the borehole wall. The known environment inside the casing string provides a more reliable surface to push against. For example, drill cuttings are unable to interfere with the operation of the RSS pad.

Advantageously, embodiments of the invention that include a casing shoe cutter enable the use of casing drilling without the need for an underreamer. The casing shoe cutter may enlarge the pilot hole drilled by the drill bit while still enabling the drill bit to pass into and through the casing string when the drill bit is retrieved.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A directional drilling system, comprising:

a casing string;

a casing latch disposed inside the casing string proximate a lower end of the casing string and coupled to the casing string;

a rotary steerable system disposed inside the casing string and coupled to the casing latch; and a drill bit operatively coupled to the rotary steerable system.

2. The directional drilling system of claim 1, further comprising an underreamer disposed below the casing string and above the drill bit, and coupled to the rotary steerable system.

3. The directional drilling system of claim 1, wherein a bottom end of the casing string comprises a casing shoe cutter.

4. The directional drilling system of claim 3, wherein the casing shoe cutter comprises a wear resistant coating.

5. The directional drilling system of claim 4, wherein the casing shoe cutter comprises cutting inserts.

6. The directional drilling system of claim 1, wherein the rotary steerable system comprises a push-the-bit system.

7. The directional drilling system of claim 1, further comprising a measurement while drilling collar disposed between the rotary steerable system and the casing latch, and coupled to the casing latch and the rotary steerable system.

8. The directional drilling system of claim 1, wherein a lower section of the casing string comprises a non-magnetic material.

9. The directional drilling system of claim 1, wherein the casing latch is an articulating casing latch.

10. A method of directional drilling, comprising:

rotating a drill bit disposed at a lower end of a casing string; and changing the direction of the drill bit by pushing against an inside of the casing string with a rotary steerable system disposed inside the casing string.

11. The method of claim 10, further comprising enlarging a pilot hole drilled by the drill bit using an underreamer coupled to the casing string.

12. The method of claim 10, wherein a bottom end of the casing string comprises a casing shoe cutter and further comprising enlarging a pilot hole drilled by the drill bit using the casing shoe cutter.

13. The method of claim 10, further comprising collecting data related to formation properties using instruments disposed in a measurement while drilling collar.

* * * * *